US006293774B1

(12) United States Patent
Brabek

(10) Patent No.: US 6,293,774 B1
(45) Date of Patent: Sep. 25, 2001

(54) REFRIGERATING AGENT COMPRESSOR WITH IMPROVED VALVE

(75) Inventor: Walter Brabek, Jennersdorf (AT)

(73) Assignee: Verdichter OE. GesmbH, Furstenfeld (AT)

( * ) Notice: Subject to any disclaimer, the term of this patent is extended or adjusted under 35 U.S.C. 154(b) by 0 days.

(21) Appl. No.: 09/554,808

(22) PCT Filed: Dec. 10, 1998

(86) PCT No.: PCT/AT98/00303

§ 371 Date: May 19, 2000

§ 102(e) Date: May 19, 2000

(87) PCT Pub. No.: WO99/30037

PCT Pub. Date: Jun. 17, 1999

(30) Foreign Application Priority Data

Dec. 11, 1997 (AT) ..... 773/97 U

(51) Int. Cl.[7] ..... F04B 39/10
(52) U.S. Cl. ..... 417/569; 137/855
(58) Field of Search ..... 417/569; 137/856, 137/857, 855

(56) References Cited

U.S. PATENT DOCUMENTS

| | | | | |
|---|---|---|---|---|
| 2,151,746 | * | 3/1939 | Cody | 137/856 |
| 2,864,397 | * | 12/1958 | Hempel | 137/855 |
| 2,908,287 | * | 10/1959 | Augustin | 137/856 |
| 2,970,608 | * | 2/1961 | Doeg | 137/857 |
| 3,568,712 | * | 3/1971 | Rinehart | 137/856 |
| 4,111,231 | * | 9/1978 | Leppich | 137/857 |
| 5,178,183 | | 1/1993 | Kim | 417/569 |
| 5,209,260 | | 5/1993 | Baek | 417/569 |
| 5,456,287 | | 10/1995 | Leu | 137/855 |
| 5,779,458 | * | 7/1998 | Hong et al. | 417/569 |
| 5,857,839 | * | 1/1999 | Fisher et al. | 417/569 |
| 6,053,713 | * | 4/2000 | Brown | 417/569 |
| 6,066,785 | * | 12/1999 | Iversen | 137/856 |

FOREIGN PATENT DOCUMENTS

| | | | |
|---|---|---|---|
| 26 40 054 A1 | 3/1978 | (DE) | 137/856 |
| 40 39 786 A1 | 6/1992 | (DE) . | |
| 196 13 911 C1 | 7/1997 | (DE) | 137/856 |

* cited by examiner

*Primary Examiner*—Cheryl J. Tyler
(74) *Attorney, Agent, or Firm*—Scully, Scott, Murphy & Presser

(57) ABSTRACT

An electric refrigeration compression, in particular for household refrigerating and deep-internal freezing appliances, including an outer casing, an internal body, a piston displaceable within a cylinder, a first seal, a valve spring, a valve plate provided with a refrigerant suction bore and a valve head, wherein the value plate is provided with two recesses on its side facing the valve spring and is designed so that two laterally outwardly projecting parts of the same spring are inclined and can be inserted in the recesses and clamped therein such that a portion of the remaining surface of the valve spring is movably arranged in a position tightly abutting on the valve plate surfacer facing the interior of the cylinder. The valve spring includes a surface such that the suction bore provided in the valve plate can be closed, the two laterally outwardly projecting parts that can be clamped within the recesses, and a surface that is held in tight abutment on the valve plate side facing the cylinder by means of a seal.

4 Claims, 4 Drawing Sheets

REFRIGERATING AGENT COMPRESSOR WITH IMPROVED VALVE

BACKGROUND OF THE INVENTION

The invention relates to a special design of a hermetic refrigeration compressor provided, in particular, for use in connection with household refrigerating and/or deep-freezing appliances, namely that compressor part which comprises the refrigerant suction components within the cylinder of the compressor.

It is well known that the refrigeration compressors used in refrigerating and deep-freezing appliances are standardized products, wherein compressor manufacturers have incessantly and persistently endeavored to allow such products to become more and more competitive in terms both of general efficiency and costs by constant improvements to the last detail.

One of the most critical components used in such refrigeration compressors undoubtedly is the refrigerant suction check valve, i.e., that valve which lets the refrigerant into the compression cylinder and, at the same time, prevents the same from flowing back from said cylinder. Such a valve usually has the form of a tongue valve made of high-strength and highly elastic steel, which is also called spring valve in the technical jargon such that the following description generally refers to a spring valve or rather a valve spring.

It is generally known that a spring valve usually is comprised of a small and extremely thin special steel plate, which in its central region has a bent indent which defines the zone constituting the valve spring proper, i.e. the movable part of the valve, and clears and seals the suction bore provided in the valve plate.

Such a thin plate is retained in its position by the provision of respective throughbores in its corners, in which suitable screw bolts can be screwed which are used for clamping the inner body of the compressor, the valve head, the valve plate, the valve spring and possibly interposed seals in a manner that the structural components mentioned will be held together practically as a single body.

This is definitely a technique known to everybody skilled in the art and does not need any further explanations.

The problem to be solved rather is related to the actual application of the valve spring, for the manufacture of which very expensive special alloys are presently used, which, however, are not specifically required for the manufacture of the whole plate. It is only the movable plate part which is comprised of a small tongue or spring as well as its transition zone acting as a hinge, which make such function-related demands that can be effectively met only by employing high-performance special alloys, which are usually very expensive.

It would, therefore, doubtlessly be of great advantage to limit the application of such alloys merely to the movable spring and the associated transition zone and, at the same time, use more cost-effective materials for the remaining part of the plate, since that remaining part is clearly less demanding in terms of performance. According to another known solution, which is effective as such, the plate of the spring valve is practically eliminated completely, keeping but its movable tongue, i.e., the spring proper, wherein said spring is then connectable with the valve plate by one or several pins which are inserted in respective bores provided in the valve plate and, at the same time, fix the movable spring.

As has become known from DE 19 613 911 C1, the spring also may comprise two bent-up lugs arranged laterally so as to be offset in the longitudinal direction of the spring, which reach into respective recesses. Likewise, it is feasible to design the valve spring symmetrically without bent-up lugs, as in correspondence with the design according to U.S. Pat. No. 5,456,287.

Such solutions, however, have the disadvantage of involving some additional manufacturing sequences such as, e.g., the realization of bores and the insertion of the respective studs. Moreover, the quite considerable costs of such studs are to be taken into account.

SUMMARY OF THE INVENTION

It is, therefore, desirable and, at the same time, the object of the present invention to propose a refrigeration compressor which is provided with a spring valve or similar device that ensures the same function of the above-mentioned valve arrangement at clearly reduced production costs without any change of the high efficiency and functionability and which, in addition, is cost-effective and easy to assemble using conventional materials and manufacturing processes according to the present state of the art. The characterizing features of the invention are defined in more detail in the annexed claims.

In accordance with the invention, this object is achieved by the technical solutions explained in more detail below in the form of a non-limiting example with reference to the accompanying drawings.

DESCRIPTION OF EXEMPLARY EMBODIMENTS

Figure 1:
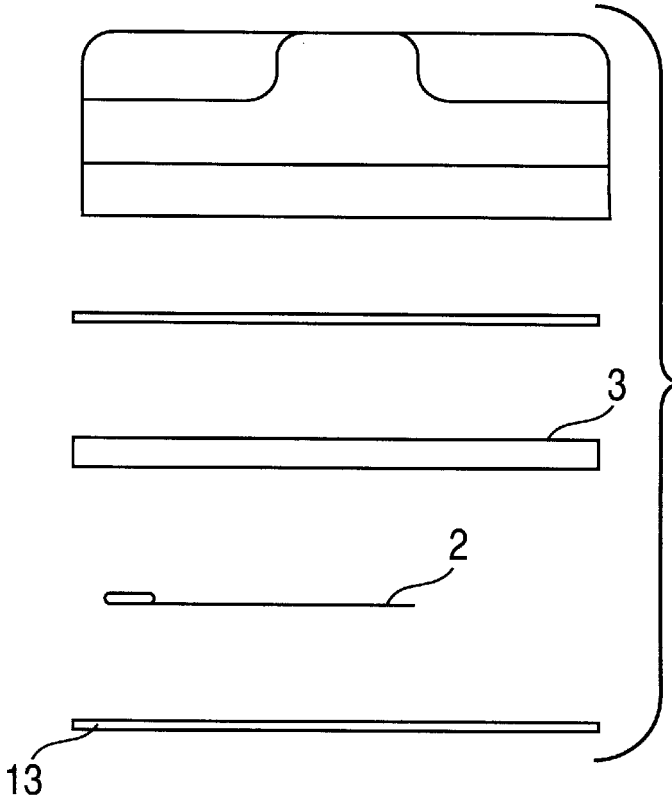
FIG. 1 is a sectional view of some structural components that are connected with the compressor head.
Figure 1A:
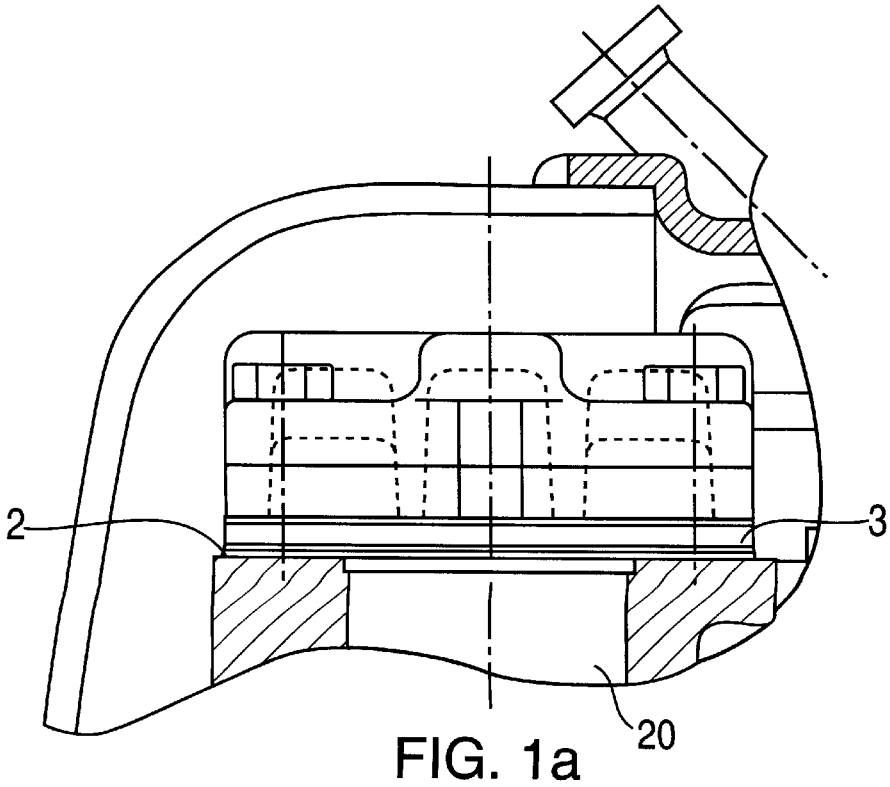
FIG. 1*a* is an illustration of the structural components according to the invention mounted to the compressor head.

The concept underlying the present invention will be explained in more detail in the following: With reference to the Figures and, in particular, FIGS. 2 to 7, it will be noted that the usual valve spring has been replaced with a smaller valve spring 2 according to the invention, which differs from the conventional design in that it is restricted in its size and no longer extends over the substantially entire surface of the valve plate 3, yet is fastened by means of the same screw bolts which retain the valve plate in its seat. To be more precise, the valve spring 2 according to the invention is comprised of three different sections, i.e., a first section 5 serving to seal the suction bore 12, a second section 6 capable of being blocked against the valve plate in a particular manner described in more detail below, and a third section 7 acting as an elastic joint which, in turn, interconnects the two sections 5 and 6, as is apparent from FIG. 6.

Figure 5:
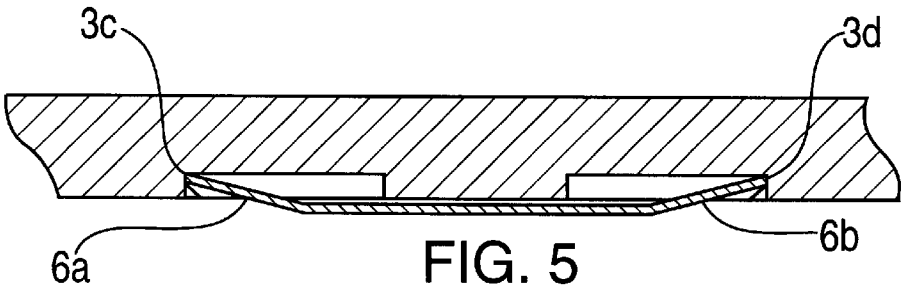
FIG. 5 is a sectional view of the valve plate according to FIG. 4, viewed along the area of section 5—5.
Figure 6:
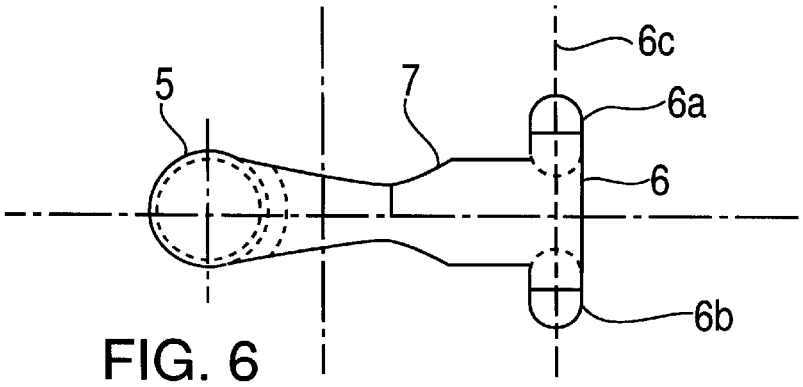
FIG. 6 is a ground sectional view only of the valve spring according to FIG. 4.

The second section 6 is provided with two outwardly projecting parts 6*a* and 6*b* arranged in opposite relationship, preferably on the same axis 6*c*, said outwardly projecting parts 6*a* and 6*b* being slightly inclined laterally relative to the plane of the other sections of the spring valve, as is apparent from FIG. 5.

Figure 2:
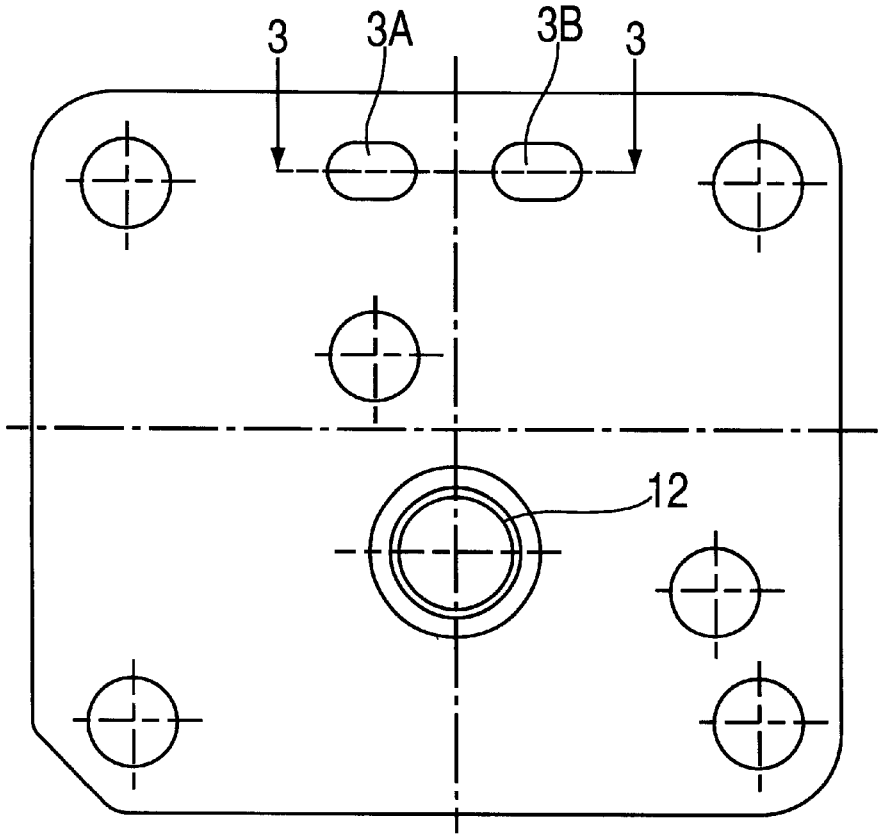
FIG. 2 is a ground sectional view of the valve plate front side according to the present invention, viewed from the cylinder.
Figure 3:
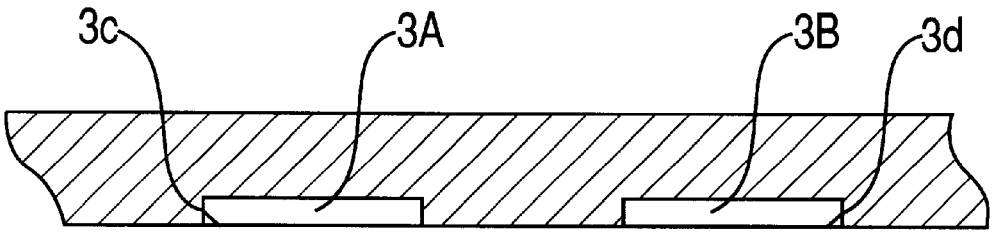
FIG. 3 is a sectional view of the valve plate according to FIG. 2 viewed along the area of section 3—3.
Figure 4:
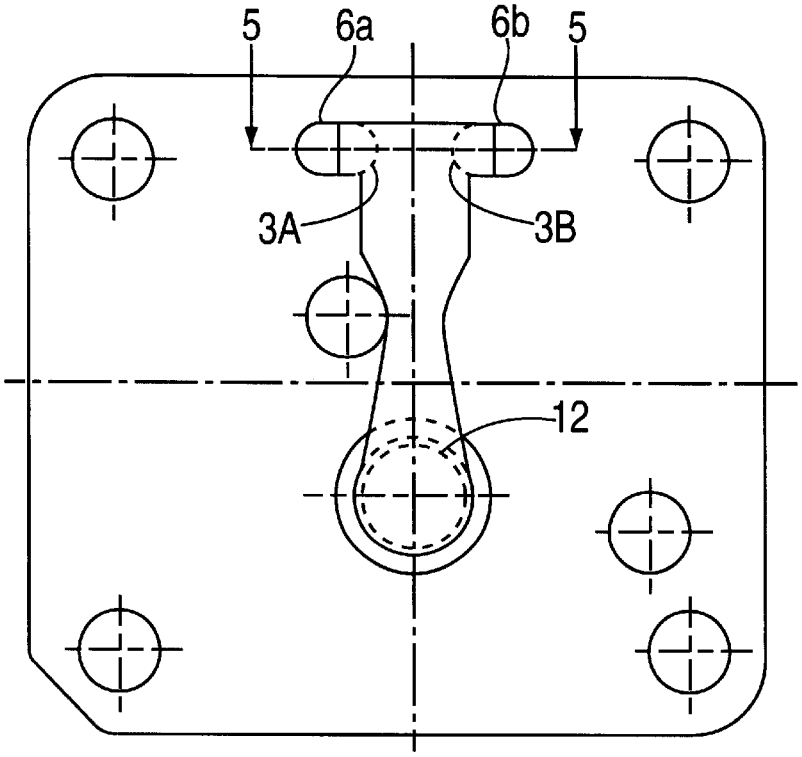
FIG. 4 is a ground sectional view of the front side of the valve plate according to the present invention provided with the valve spring, viewed from the cylinder.

As can be taken, in particular, from FIG. 2 and FIG. 3, two recesses 3A and 3B are provided in the valve plate 3 on the side facing the cylinder 20, whose inner edges 3*c* and 3*d* at least partially are acute-angled. In this case, both the recesses and the outwardly projecting parts 6*a* and 6*b* of the valve spring are designed, dimensioned and arranged in a manner that the valve spring 2 according to the invention is attachable to the associated valve plate 3. Therein, the two outwardly projecting parts 6*a* and 6*b* are elastically bent in order to enable the same to be inserted into the aforementioned recesses 3A and 3B and there have a firm and stable seat, in particular by clamping the outwardly projecting parts against the inner edges 3*c* and 3*d*, as is schematically illustrated in FIG. 4 and, in particular, FIG. 5.

The first section 5 of the valve spring in that stable clamping position is arranged precisely on the suction bore 12 in a manner so as to be able to close the same tightly.

Thus, a valve spring construction is obtained, which obviates the wasting of expensive material that is usually required for the manufacture of whole valve plates. Such a material is provided merely for the spring valve parts that are necessary for closing the suction bore, for retaining the spring valve and for the section 7 that acts as an elastic hinge joint connecting the first section 5 with the second section 6 of the valve spring.

Figure 7:
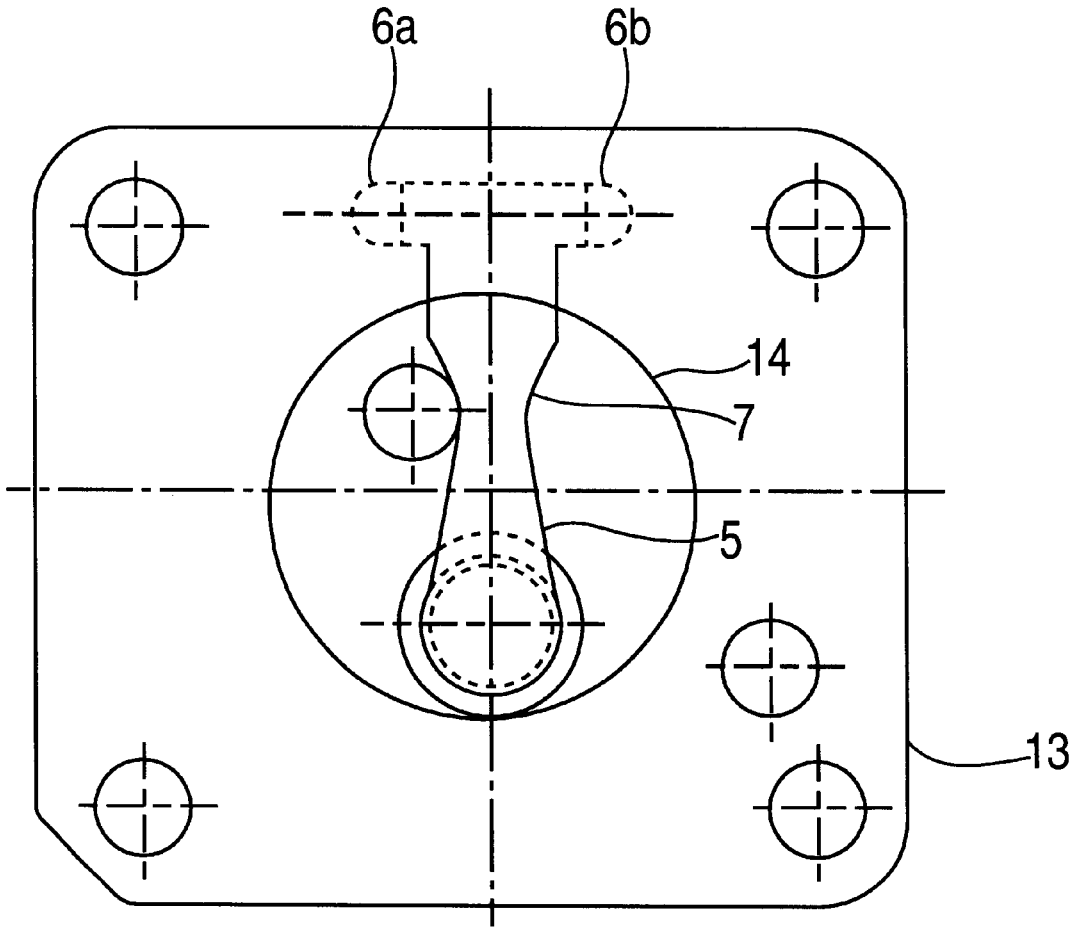
FIG. 7 is a ground sectional view of the front side of the valve plate provided with the valve spring according to the present invention and partially covered by the seal.

In order to clamp said valve spring in a more stable and reliable manner, a seal 13 is preferably arranged, in particular according to the illustration depicted in FIG. 7, which in its central section has an opening 14 that leaves uncovered both the first valve spring section 5 serving to seal the suction bore 12 and the third connecting section 7 serving as an elastic hinge joint, yet completely covers the two outwardly projecting parts 6*a* and 6*b*, this, together with the above-described clamping of said outwardly projecting parts 6*a* and 6*b*, specifically contributing to an enhanced stabilization of the entire valve spring in its correct operating position, i.e., in tight abutment on the valve plate.

It will be readily appreciated that the description and the above explanations have been indicated merely as a non-limiting example for elucidating the invention and that various alternatives and modifications may be provided without leaving the scope of protection of the present invention.

What is claimed is:

1. An electric refrigeration compressor, in particular for household refrigerating and deep-freezing appliances, including an outer casing, an inner body, a piston displaceable within a cylinder (20), a first seal (13), a valve spring (2), a valve plate (3) provided with a refrigerant suction bore (12) and a valve head, wherein the valve plate is provided with two recesses (3A, 3B) on a side facing the valve spring and the valve spring includes two laterally outwardly projecting parts (6*a*, 6*b*) that are inclined relative to the plane of the valve spring, characterized in that said valve spring is symmetrical and said two recesses (3A, 3B) are located substantially symmetrical relative to the axis of symmetry of said valve spring and said inclined outwardly projecting parts (6*a*, 6*b*) are inserted in said recesses and clamped therein such that a portion of the remaining surface of the valve spring is movably arranged in a position tightly abutting on the valve plate surface facing the interior of the cylinder, and wherein the two outwardly projecting parts (6*a*, 6*b*) and recesses (3A, 3B) are arranged, in their mutually clamped relationship in a manner such that the valve spring is placed against said suction bore (12).

2. An electric refrigeration compressor according to claim 1, characterized in that the valve spring essentially consists of three sections, a first said section (5) being a sealing surface for closing the suction bore in the valve plate, a second said section (6) being comprised of the two outwardly projecting parts (6*a*, 6*b*) which are clamped within said recesses, and a third section (7) of the valve spring being located between said first and second sections serving to interconnect said first and second sections.

3. An electric refrigeration compressor according to claim 2, characterized in that the first seal (13) is located between said valve spring and said valve head, wherein in its central section it is provided with an opening (14) that leaves uncovered both said first section (5) and, at least partially, said third section (7) of the valve spring.

4. An electric refrigeration compressor according to claim 1, characterized in that said two recesses (3A, 3B) are each provided with at least one acute-angled inner edge (3*c*, 3*d*), and wherein the outer edges of said inclined outwardly projecting parts (6*a*, 6*b*) are clamped against a respective said inner edge.

* * * * *